US007281455B2

(12) United States Patent
Hu

(10) Patent No.: US 7,281,455 B2
(45) Date of Patent: Oct. 16, 2007

(54) TOOL HANDLE WITH BIT CARRIER

(76) Inventor: Bobby Hu, 8F, No. 536-1, Ta Chin Street, Taichung (TW)

( * ) Notice: Subject to any disclaimer, the term of this patent is extended or adjusted under 35 U.S.C. 154(b) by 0 days.

(21) Appl. No.: 11/279,975

(22) Filed: Apr. 17, 2006

(65) Prior Publication Data

US 2006/0288531 A1 Dec. 28, 2006

(30) Foreign Application Priority Data

Jun. 14, 2005 (TW) ..... 94119726 A

(51) Int. Cl.
*B25B 23/16* (2006.01)
*B25G 1/08* (2006.01)
*B25G 3/24* (2006.01)

(52) U.S. Cl. ..... 81/177.4; 81/490

(58) Field of Classification Search ..... 81/177.4, 81/439, 490; 403/290, 326, 329
See application file for complete search history.

(56) References Cited

U.S. PATENT DOCUMENTS 7,051,626 B1 * 5/2006 Chen et al. ..... 81/438

* cited by examiner

*Primary Examiner*—David B Thomas
(74) *Attorney, Agent, or Firm*—Alan Kamrath; Kamrath & Associates PA

(57) ABSTRACT

A tool handle includes a body, a bit carrier, and an actuating member. An end of the body includes a compartment. One of two lateral sides of the body has an opening in communication with the compartment. The bit carrier is mounted in the compartment of the body and movable relative to the body in a longitudinal direction. The bit carrier includes a bit-holding section for holding at least one bit. A retaining member is mounted to the bit carrier for retaining the bit carrier to the body. The actuating member is mounted in the opening of the body. The actuating member is operable to move the bit carrier from a storage position to an ejected position without falling out of the body and to impart a frictional force between the retaining member and the body to prevent the bit carrier from falling out of the body.

38 Claims, 20 Drawing Sheets

TOOL HANDLE WITH BIT CARRIER

BACKGROUND OF THE INVENTION

1. Field of the Invention

The present invention relates to a tool handle. More particularly, the present invention relates to a tool handle with a bit carrier.

2. Description of the Related Art

Some screwdrivers include a compartment in the handle for receiving several bits for use with screws of various types. The bits are apt to fall from the screwdriver and scatter when the screwdriver falls to the ground. A solution to this problem is providing a threaded cap on the handle for sealing the bits in the handle, yet retrieval of the bits is troublesome and time-consuming.

Another proposal is a bit box that is ejected out of the screwdriver handle when a button on the handle is pressed. The retaining effect for the bit box in the handle, however, is unsatisfactory. The bit box is liable to fall out of the handle when the screwdriver is impinged or falls to the ground. Further, the structure for retaining the bit box in place is generally made of plastics and thus has poor toughness. Namely, the retaining structure is liable to fatigue. Further, the retaining structure is liable to age and crack when it comes in contact with oil or the like. In brief, the conventional retaining structure has a short life and can not provide a reliable retaining effect.

SUMMARY OF THE INVENTION

In accordance with an aspect of the present invention, a tool handle comprises a body, a bit carrier, and an actuating member. The body includes a first end and a second end. The first end of the body is adapted for coupling with a bit-coupling member. The second end of the body includes a compartment. The body further includes two lateral sides. One of the lateral sides has an opening in communication with the compartment. A bit carrier is mounted in the compartment of the body and movable relative to the body in a longitudinal direction. The bit carrier includes a bit-holding section for holding at least one bit. A retaining member is mounted to the bit carrier for retaining the bit carrier to the body. The actuating member is mounted in the opening of the body. The actuating member is operable to move the bit carrier from a storage position to an ejected position not falling out of the body and to impart a frictional force between the retaining member and the body to prevent the bit carrier from falling out of the body.

Preferably, the body further includes an additional opening in the other lateral side thereof, and the tool handle further includes another actuating member mounted in the additional opening. These two actuating members are operable to together move the bit carrier from the storage position to the ejected position and to impart the frictional force between the retaining member and the body to prevent the bit carrier from falling out of the body.

Preferably, the opening of the body includes an engaging portion. The actuating member includes a coupling section coupled with the engaging portion.

Preferably, the retaining member includes a main section and a resilient arm extending outward and rearward from an end of the main section. The actuating member includes a pressing section abutting against the resilient arm of the retaining member.

Preferably, the body includes a stop formed in the opening. The resilient arm of the retaining member abuts against the stop of the body when the bit carrier is in the storage position, thereby retaining the bit carrier in the compartment of the body.

Preferably, the bit carrier includes a recessed portion for receiving the resilient arm of the retaining member.

Preferably, the bit carrier includes an engaging groove for receiving the main section of the retaining member.

Preferably, a lateral wall delimiting the compartment of the body includes a guiding groove along which the resilient arm of the retaining member slides. The resilient arm includes a retaining section in frictional contact with a wall delimiting the guiding groove.

Preferably, the retaining member is a resilient metal plate.

Preferably, a metal plate is mounted to an outer side of the actuating member.

Preferably, the bit carrier is forcibly removable from the compartment of the body.

Preferably, the compartment of the body is delimited by two lateral walls each having a longitudinally extending groove. The bit carrier includes two longitudinal ribs slidingly received in the grooves of the body.

Preferably, the tool handle further includes an elastic element mounted in the compartment for biasing the bit carrier outward.

Preferably, the compartment of the body is delimited by an end wall that includes a fixing block to which an end of the elastic element is mounted.

Preferably, the end wall includes a recess in which the fixing block is formed.

Preferably, at least a portion of the bit-holding section is exposed when the bit carrier is in the ejected position.

The guiding groove may be arcuate.

In another example, a bottom wall delimiting the guiding groove includes a protrusion for stopping the retaining section of the resilient arm.

In accordance with another aspect of the present invention, a tool handle comprises a body, a bit carrier, and two actuating members. The body includes a first end and a second end. The first end of the body is adapted for coupling with a bit-coupling member. The second end of the body includes a compartment. The body further includes two lateral sides. Each lateral side has opening in communication with the compartment. A bit carrier is mounted in the compartment of the body and movable relative to the body in a longitudinal direction. The bit carrier includes a bit-holding section for holding at least one bit. A retaining member is mounted to the bit carrier for retaining the bit carrier in the compartment of the body. The actuating members are respectively mounted in the openings of the body. The actuating members are operable to move the bit carrier from a storage position to an ejected position not falling out of the body and to impart a frictional force between the retaining member and the body to prevent the bit carrier from falling out of the body.

Preferably, each opening of the body includes an engaging portion. Each actuating member includes a coupling section coupled with the engaging portion of an associated opening.

Preferably, the retaining member is substantially U-shaped and includes a main section and two resilient arms extending outward and rearward from two ends of the intermediate section. Each actuating member includes a pressing section abutting against an associated resilient arm of the retaining member.

Preferably, the body includes two stops respectively formed in the openings. Each resilient arm of the retaining member abuts against an associated stop of the body when the bit carrier is in the storage position, thereby retaining the bit carrier in the compartment of the body.

Preferably, the bit carrier includes two recessed portions for receiving the resilient arms of the retaining member.

Preferably, the bit carrier includes an engaging groove for receiving the main section of the retaining member.

Preferably, each of two lateral walls delimiting the compartment of the body includes a guiding groove along which an associated resilient arm of the retaining member slides. Each resilient arm includes a retaining section in frictional contact with a wall delimiting an associated guiding groove.

Preferably, the retaining member is a resilient metal plate.

Preferably, a metal plate is mounted to an outer side of each actuating member.

Preferably, the bit carrier is forcibly removable from the compartment of the body.

Preferably, the compartment of the body is delimited by two lateral walls each having a longitudinally extending groove. The bit carrier includes two longitudinal ribs slidingly received in the grooves of the body.

Preferably, an elastic element is mounted in the compartment for biasing the bit carrier outward.

Preferably, the compartment of the body is delimited by an end wall that includes a fixing block to which an end of the elastic element is mounted.

Preferably, the end wall includes a recess in which the fixing block is formed.

Preferably, the bit carrier includes an anti-sliding portion on each of two sides thereof, allowing the bit carrier to be grasped by a user for forcibly removing the bit carrier out of the compartment of the body.

Preferably, at least one of the anti-sliding portions includes at least one groove for reducing a weight of the bit carrier.

Preferably, at least a portion of the bit-holding section is exposed when the bit carrier is in the ejected position.

Each guiding groove may be arcuate.

In another example, a bottom wall delimiting each guiding groove includes a protrusion for stopping the retaining section of an associated resilient arm.

Other objectives, advantages, and novel features of the invention will become more apparent from the following detailed description when taken in conjunction with the accompanying drawings.

DETAILED DESCRIPTION OF THE PREFERRED EMBODIMENTS

Figure 1:
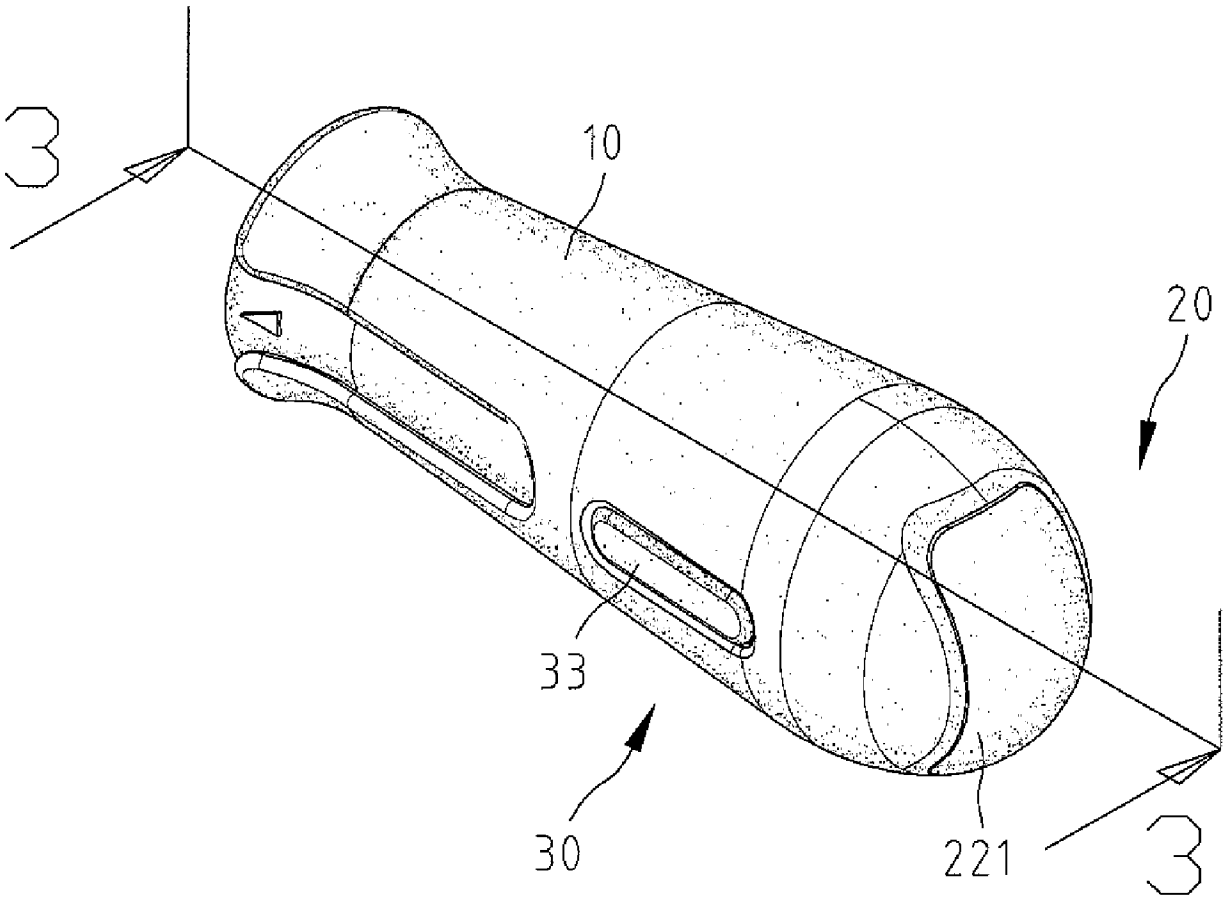
FIG. 1 is a perspective view of a first embodiment of a tool handle in accordance with the present invention.

Referring to FIG. 1, a first embodiment of a tool handle in accordance with the present invention comprises a body 10, a bit carrier 20, and two actuating members 30 respectively mounted on two lateral sides of the body 10.

Figure 2:
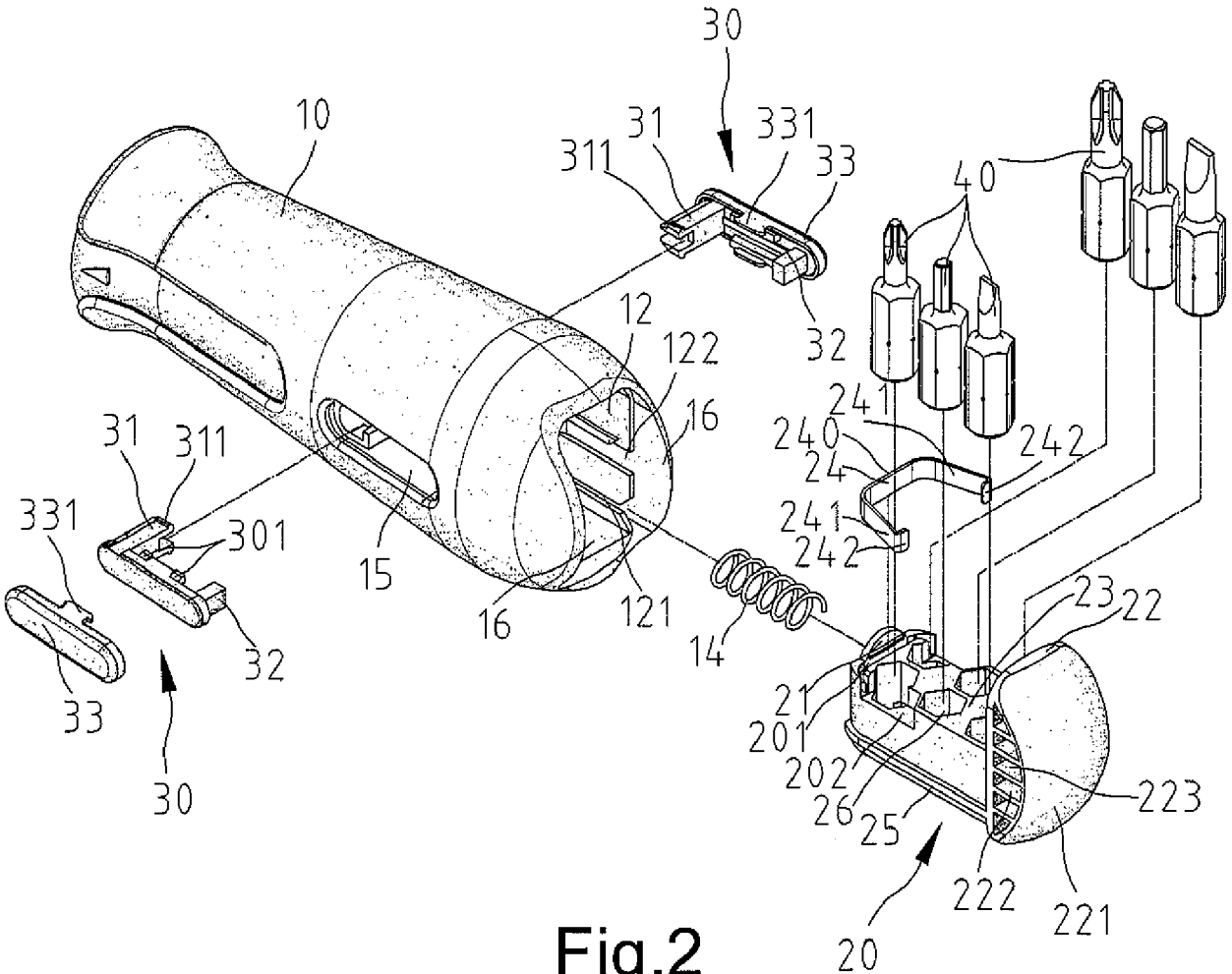
FIG. 2 is an exploded perspective view of the tool handle in accordance with the present invention.
Figure 3:
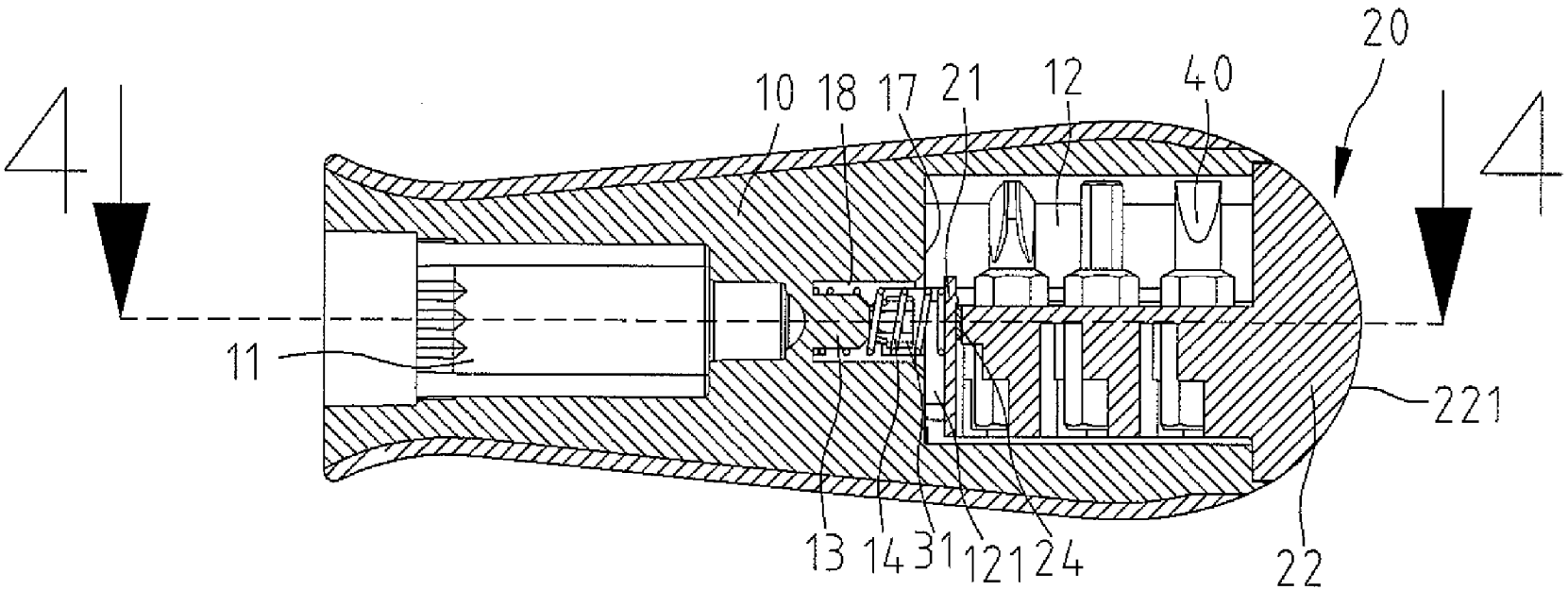
FIG. 3 is a sectional view taken along plane 3-3 in FIG. 1.
Figure 19:
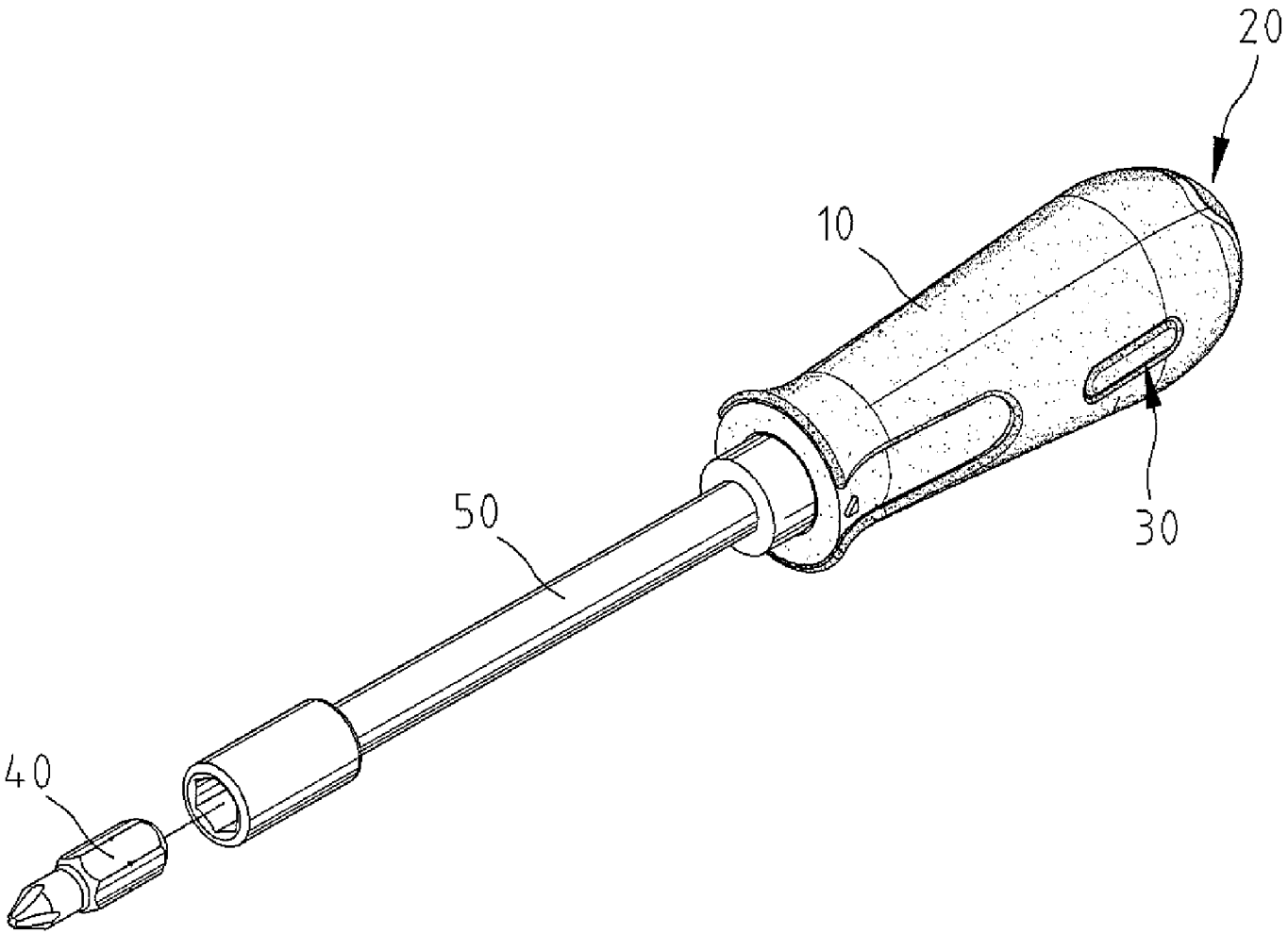
FIG. 19 is an exploded perspective view illustrating use of the tool handle in accordance with the present invention with a bit-coupling member without a ratchet mechanism.
Figure 20:
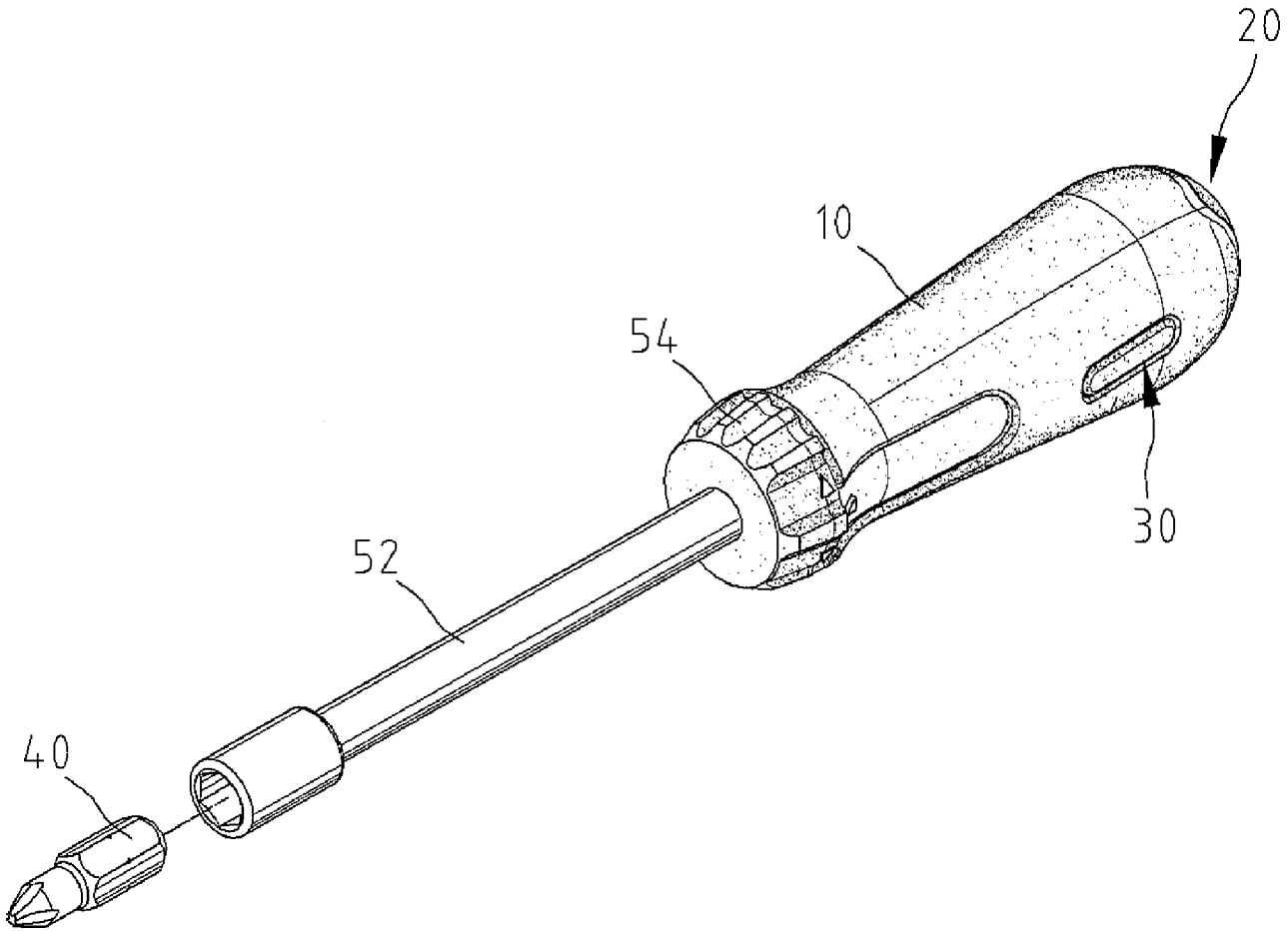
FIG. 20 is an exploded perspective view illustrating use of the tool handle in accordance with the present invention with a bit-coupling member with a ratchet mechanism.

Referring to FIGS. 2 and 3, the body 10 is substantially cylindrical and can be held by a user when in use. A coupling groove 11 is defined in a first end of the body 10 for releasably coupling with a bit-coupling member. The bit-coupling member may include a shank 50 without a ratchet mechanism, as shown in FIG. 19. Alternatively, as illustrated in FIG. 20, the bit-coupling member may include a shank 52 with a ratchet mechanism 54 that allows a change in the driving direction and free rotation direction of the tool handle for driving a fastener. A compartment 12 is defined in a second end of the body 10 and defined by two lateral walls 16 and an end wall 17. A groove 121 is defined in each lateral wall 16 and extends in a longitudinal direction of the body 10. The end wall 17 includes a fixing block 13. In this example, the end wall 17 includes a recess 18 in which the fixing block 13 is formed. An end of an elastic element 14 is fixed to the fixing block 13.

Figure 4:
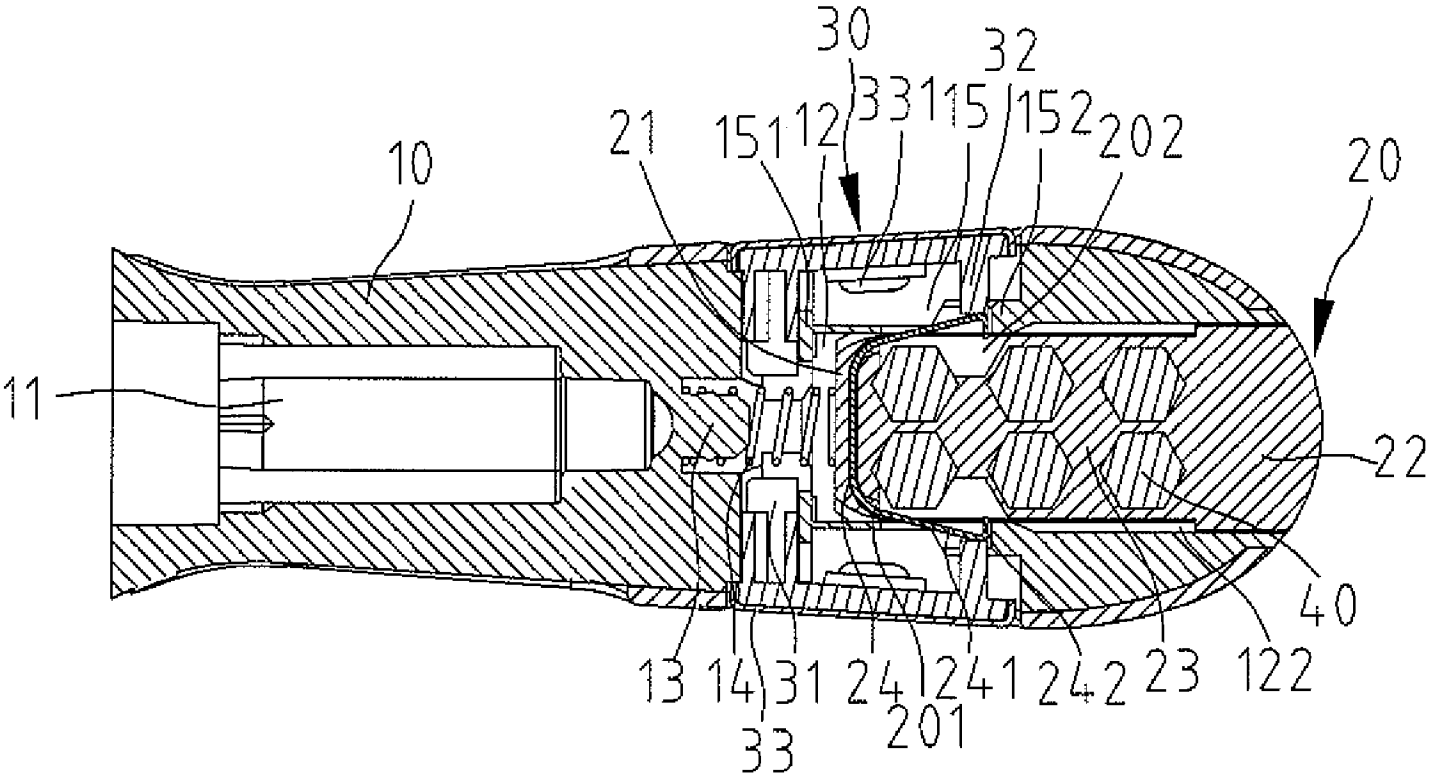
FIG. 4 is a sectional view taken along plane 4-4 in FIG. 3.

Still referring to FIGS. 2 and 3 and further to FIG. 4, each lateral side of the body 10 includes an opening 15 in communication with the compartment 12. Each opening 15 is substantially elliptic in this example and extends in the longitudinal direction of the body 10. Each opening 15 includes a first end having an engaging portion 151 and a second end having a stop 152.

The bit carrier 20 is mounted in the compartment 12 and slidable relative to the body 10. The bit carrier 20 includes a first end having a pressing portion 21 and a second end having a head 22. A second end of the elastic element 14 abuts against the pressing portion 21. The head 22 of the bit carrier 20 has a surface 221 shaped to match with the second end of the body 10, providing an aesthetically pleasing appearance for the body 10 while allowing holding comfort when in use. Each of two lateral sides of the head 22 of the bit carrier 20 includes an anti-slide portion 222 to allow stable removal of the bit carrier 20 from the body 10. In this example, each anti-slide portion 222 has a plurality of grooves 223 to reduce the weight.

A bit-holding section 23 is located between the first end and the second end of the bit carrier 20. The bit-holding section 23 may receive one or more bits 40 of various sizes and/or types. In this example, the bit-holding section 23 includes a plurality of hexagonal grooves 26 for holding bits 40 of the type having a hexagonal shank (not labeled).

A retaining member 24 is provided between the bit-holding section 23 and the pressing portion 21 for retaining the bit carrier 20 in the compartment 12 of the body 10. In this example, the retaining member 24 is a substantially U-shaped resilient metal plate including a main section 240 and two resilient arms 241 respectively extending outward and rearward from two ends of the main sections 240. Each resilient arm 241 has a hooked retaining section 242 that abuts against the stop 152 of the associated opening 15 of the body 10 when the bit carrier 20 is received in the compartment 12 of the body 10. It is noted that the position of the stops 152 can be changed according to need.

Each lateral side of the bit carrier 20 further includes a longitudinal rib 25 that is slidingly received in an associated groove 121 of the body 10. The bit carrier 20 further includes an engaging groove 201 for receiving the main section 240 of the retaining member 24. In this example, the engaging groove 201 is arcuate, allowing the resilient arms 241 to extend outward and rearward. The bit-holding section 23 of the bit carrier 20 includes two recessed portions 2O2 for receiving the resilient arms 241 of the retaining member 24 respectively. Each lateral wall 16 of the compartment 12 of the body 10 further includes a guiding groove 122 that allows sliding movement of an associated resilient arm 241 of the retaining member 24.

Each actuating member 30 is mounted in an associated opening 15 of the body 10, allowing the user to control the retaining member 24. In this example, each actuating member 30 is substantially ellipsoidal and includes a first end having a transversely extending coupling section 31 with a snapping hook 311 for secure snapping engagement with the engaging portion 151 of the associated opening 15 of the body 10. Each actuating member 30 further includes a second end having a transversely extending pressing section 32 that abuts against an outer face of an associated resilient arm 241 of the retaining member 24.

A metal plate 33 is mounted to an outer side of each actuating member 30 that is exposed outside of the associated opening 15. Each metal plate 33 includes a pair of hooks 331 for engaging with engaging protrusions 301 on the associated actuating member 30. The metal plates 30 have strength and provide an aesthetically pleasing effect. Further, the metal plates 30 do not age even though in contact with oil on the user's hand.

FIGS. 3 and 4 show storage of the bit carrier 20 inside the tool handle. The hooked retaining sections 242 of each resilient arm 241 abut against the stops 152 of the body 10, thereby retaining the bit carrier 20 in the compartment 12 of the body 10. It is noted that the elastic element 14 is compressed in this state.

Figure 5:
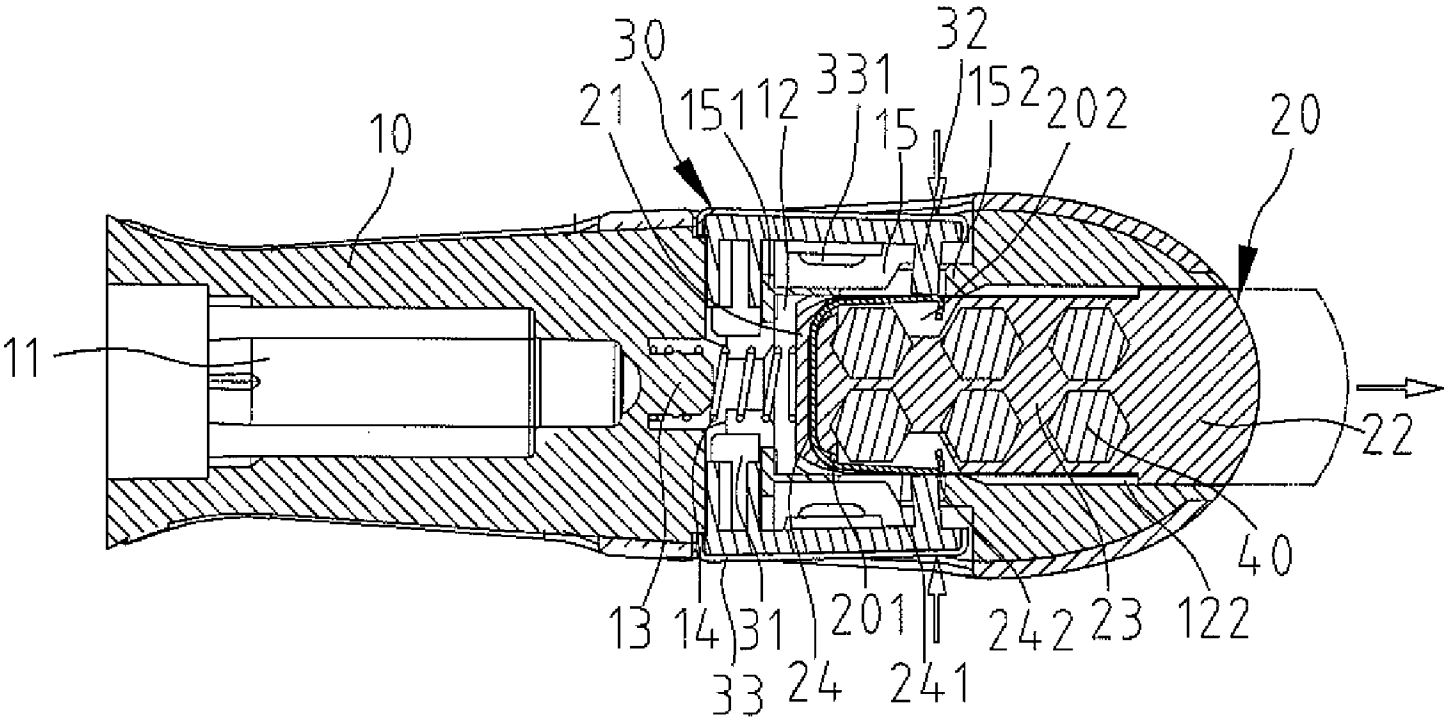
FIG. 5 is a sectional view similar to FIG. 4, illustrating ejection of a bit carrier of the tool handle.

Referring to FIG. 5, when retrieval of the bits 40 is required, the actuating members 30 are pressed, causing the pressing sections 32 of the actuating members 30 to respectively press against the resilient arms 241 of the retaining member 24. The retaining section 242 on each resilient arm 241 disengages from an associated stop 152 of the body 10 and moves into the associated recessed portion 202 of the bit carrier 20. At this time, the bit carrier 20 is not retained to the body 10 and slides outward away from the compartment 12 of the body 10 under the action of the elastic element 14.

Preferably, each actuating member 30 is slightly flexible and slightly deformable such that the snapping hooks 311 and the actuating members 30 slightly deform when the actuating members 30 are pressed, allowing the pressing sections 32 to be moved into the openings 15 of the body 10. Alternatively, the engaging portions 151 of the openings 15 of the body 10 may be in loose engagement with the coupling sections 31 of the actuating members 30 such that the snapping hooks 311 and the actuating members 30 may sway in the openings 15, allowing the pressing sections 32 to be moved into the openings 15 of the body 10.

Figure 6:
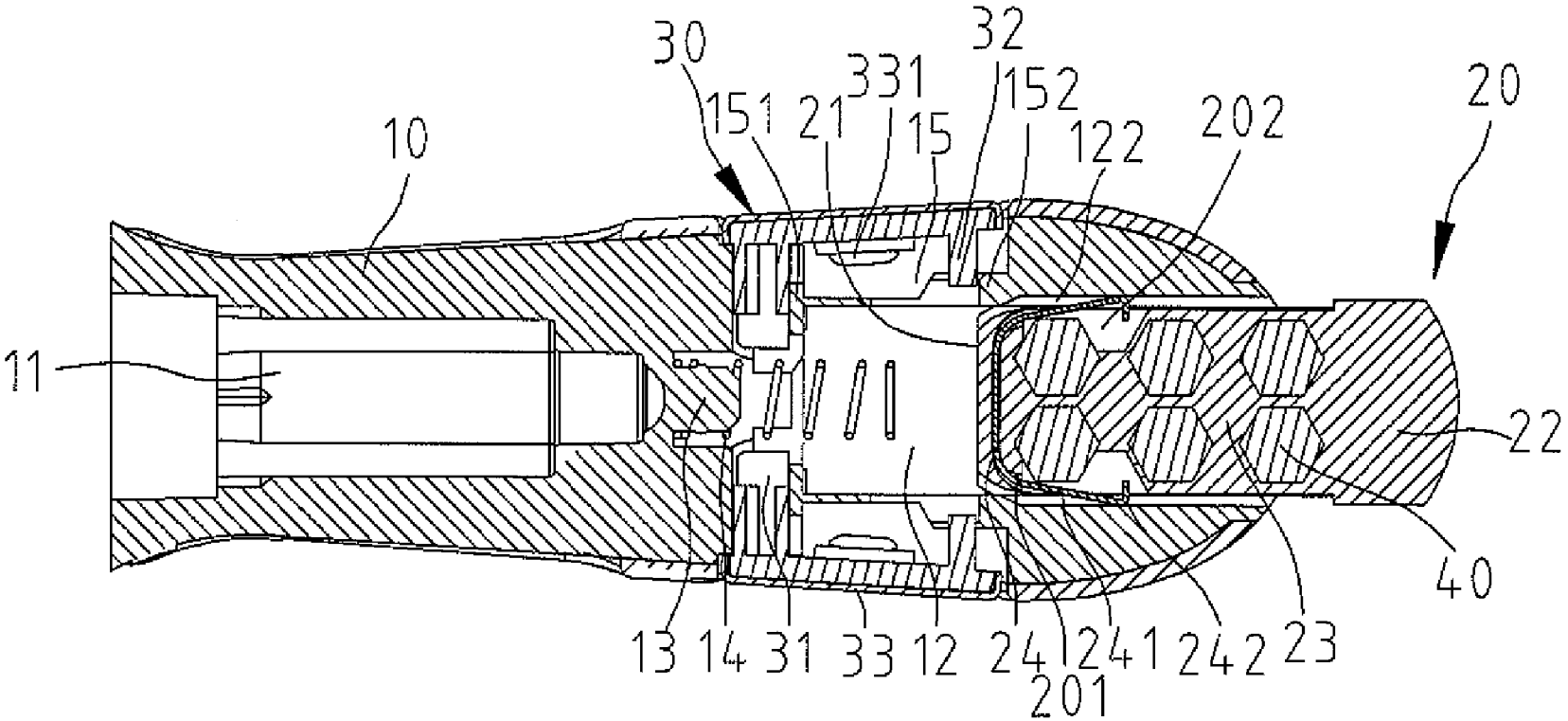
FIG. 6 is a sectional view similar to FIG. 5, wherein the bit carrier is in an ejected position.

When the bit carrier 20 is moved by the elasticity of the elastic element 14 to an ejected position shown in FIG. 6, since an outwardly extending force is imparted to each resilient arm 241 of the retaining member 24 during the sliding movement of the bit carrier 20, this outwardly extending force imparts a force to a bottom wall delimiting the associated guiding groove 122. Namely, a frictional force exists between each resilient arm 241 of the retaining member 24 and the bottom wall delimiting the associated guiding groove 122 of the body 10, preventing the bit carrier 20 from undesirably falling out of the body 10.

Figure 7:
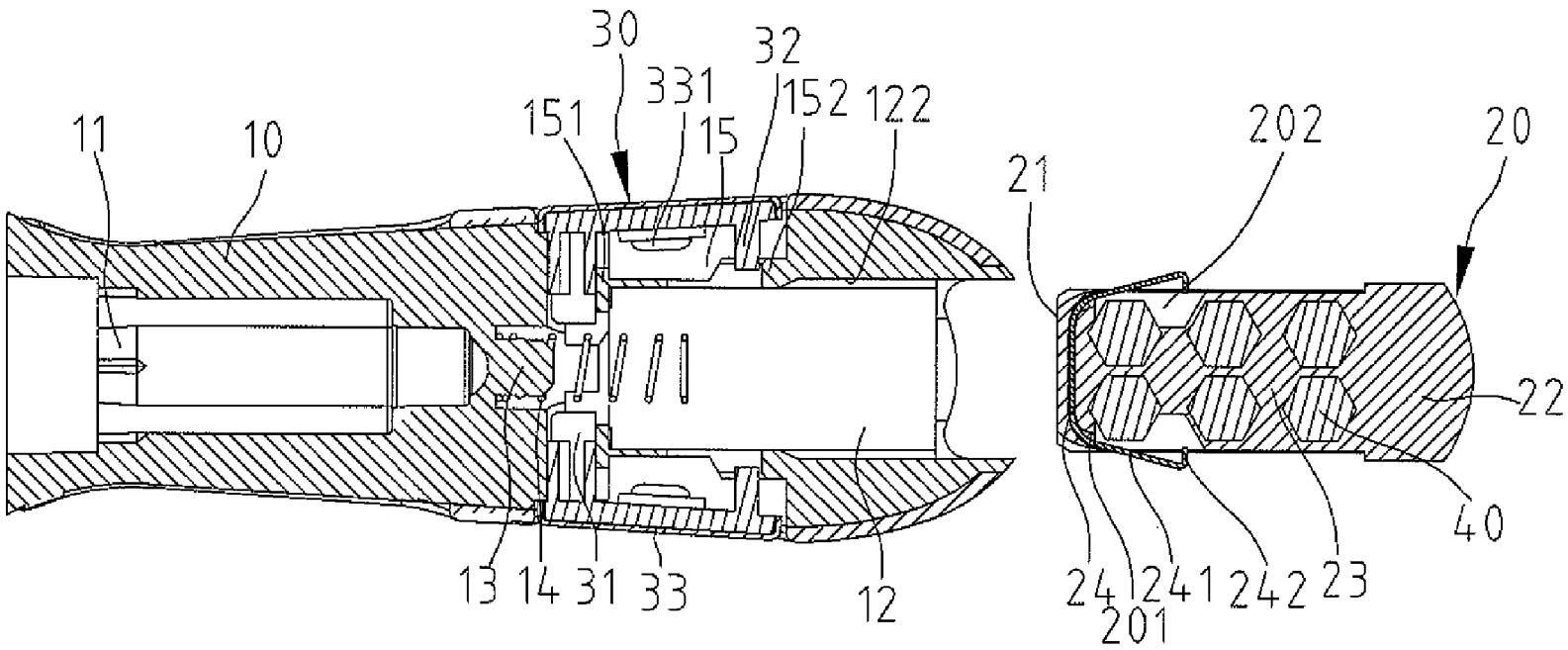
FIG. 7 is an exploded sectional view illustrating complete removal of the bit carrier from the tool handle.

Referring to FIG. 7, the user may then apply a larger force to overcome the frictional force and thus remove the bit carrier 20 from the compartment 12 of the body 10. The bits 40 held in the bit-holding section 23 can be used or bits 40 can be placed into the bit-holding section 23.

The bit carrier 20 may be placed back into the compartment 12 of the body 10. The resilient arms 241 of the retaining member 24 are moved inward into the recessed portions 202 of the bit carrier 20. When the bit carrier 20 is completely received in the compartment 12 of the body 10, each resilient arm 241 springs outward from the associated recessed portion 202 to a position abutting against the associated stop 152 of the body 10, as shown in FIG. 4.

Since a metal plate 33 is provided on the outer side of each actuating plate 30, the user's hand, even though covered with oil, would not cause aging of the actuating plates 30, as the user's hand are not in direct contact with the actuating plates 30. Aging of the metal retaining member 24 is also less likely to occur. The life of the tool handle is prolonged. Further, manufacture of the bit carrier 20 is simple, for the bit carrier 20 can be formed by injection molding to form the bit-holding section 23.

It is noted that the tool handle may include only one opening 15 and only one actuating member 30. In this case, the retaining member 24 includes only one resilient arm 241.

Figure 8:
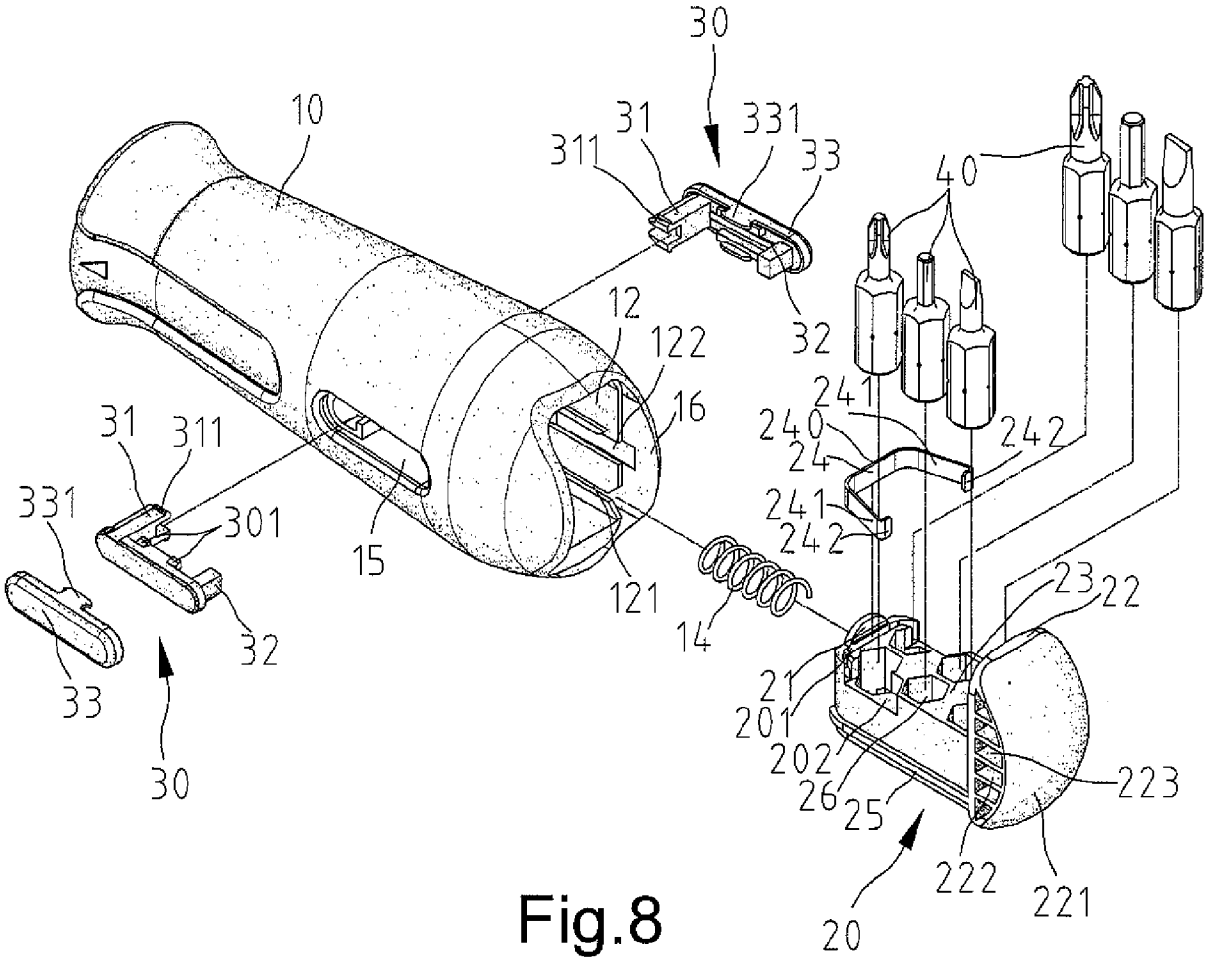
FIG. 8 is an exploded perspective view illustrating a second embodiment of the tool handle in accordance with the present invention.
Figure 9:
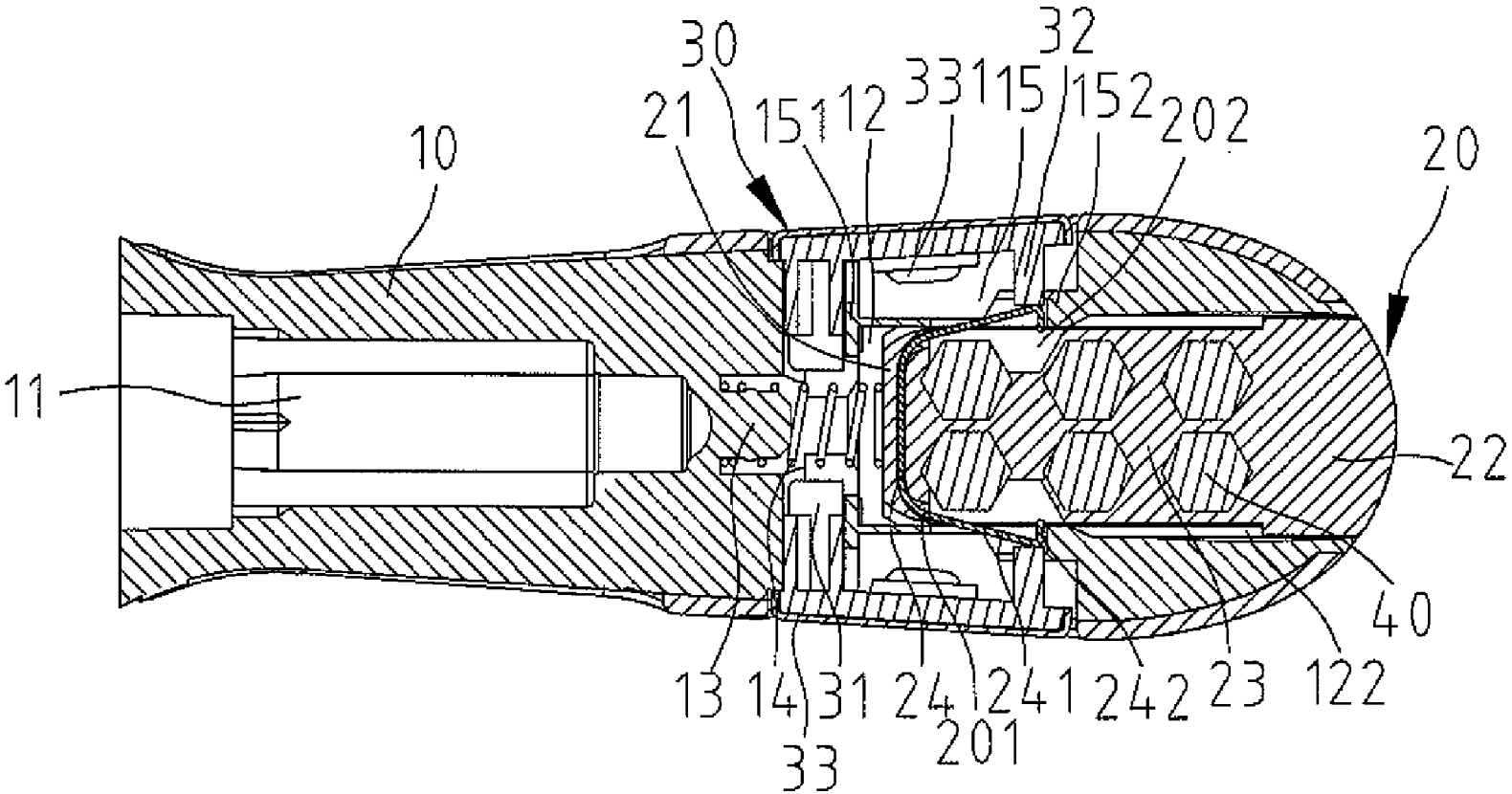
FIG. 9 is a sectional view of the tool handle in FIG. 8.

FIGS. 8 and 9 illustrate a second embodiment of the tool handle in accordance with the present invention. In this embodiment, each guiding groove 122 of the body 10 is arcuate.

Figure 10:
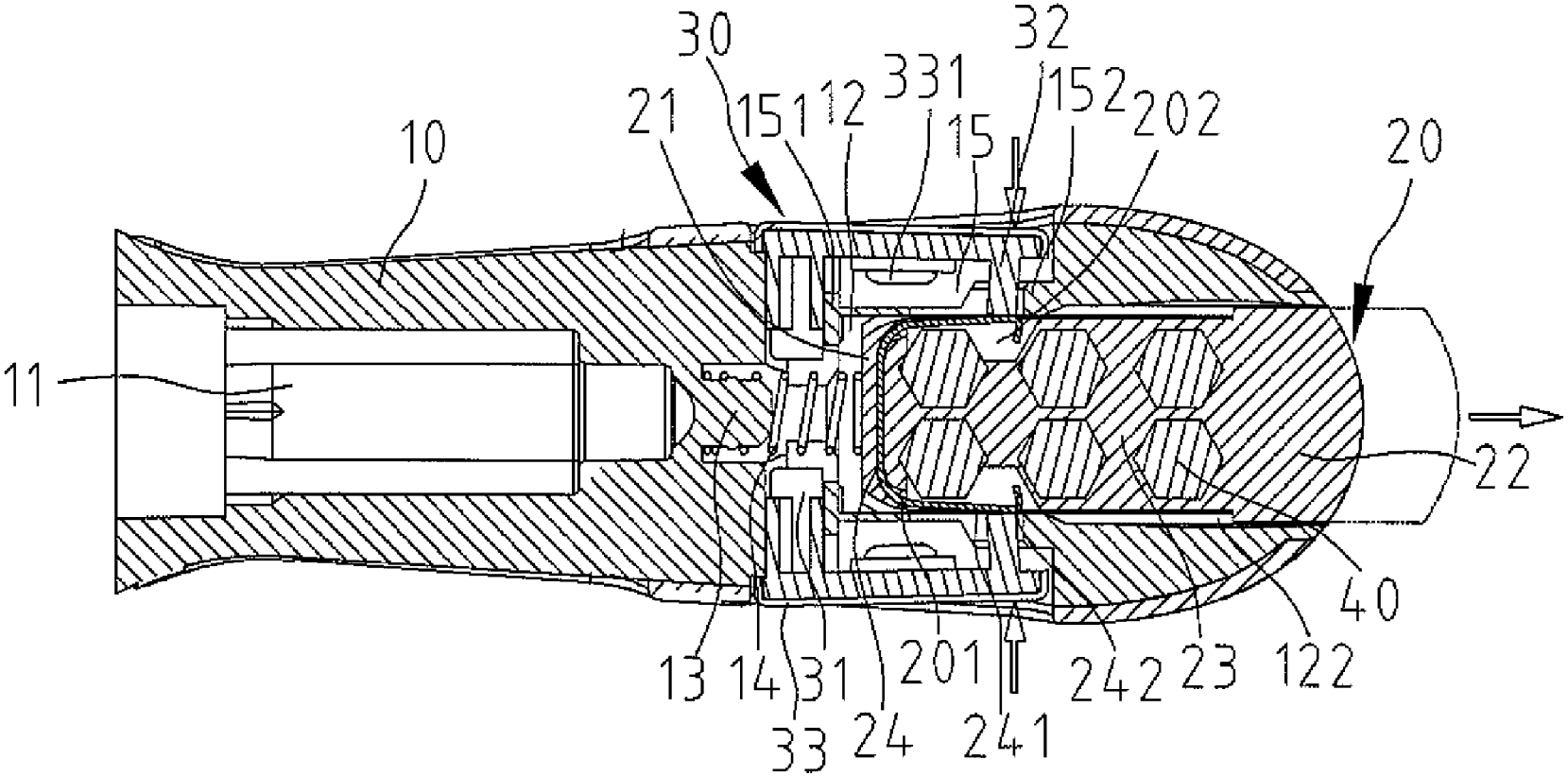
FIG. 10 is a sectional view similar to FIG. 9, illustrating ejection of a bit carrier of the tool handle.

Referring to FIG. 10, when retrieval of the bits 40 is required, the actuating members 30 are pressed, causing the pressing sections 32 of the actuating members 30 to respectively press against the resilient arms 241 of the retaining member 24. The retaining section 242 on each resilient arm 241 disengages from an associated stop 152 of the body 10 and moves into the associated recessed portion 202 of the bit carrier 20. At this time, the bit carrier 20 is not retained to the body 10 and slides outward to an ejected position shown in FIG. 11 under the action of the elastic element 14.

Figure 11:
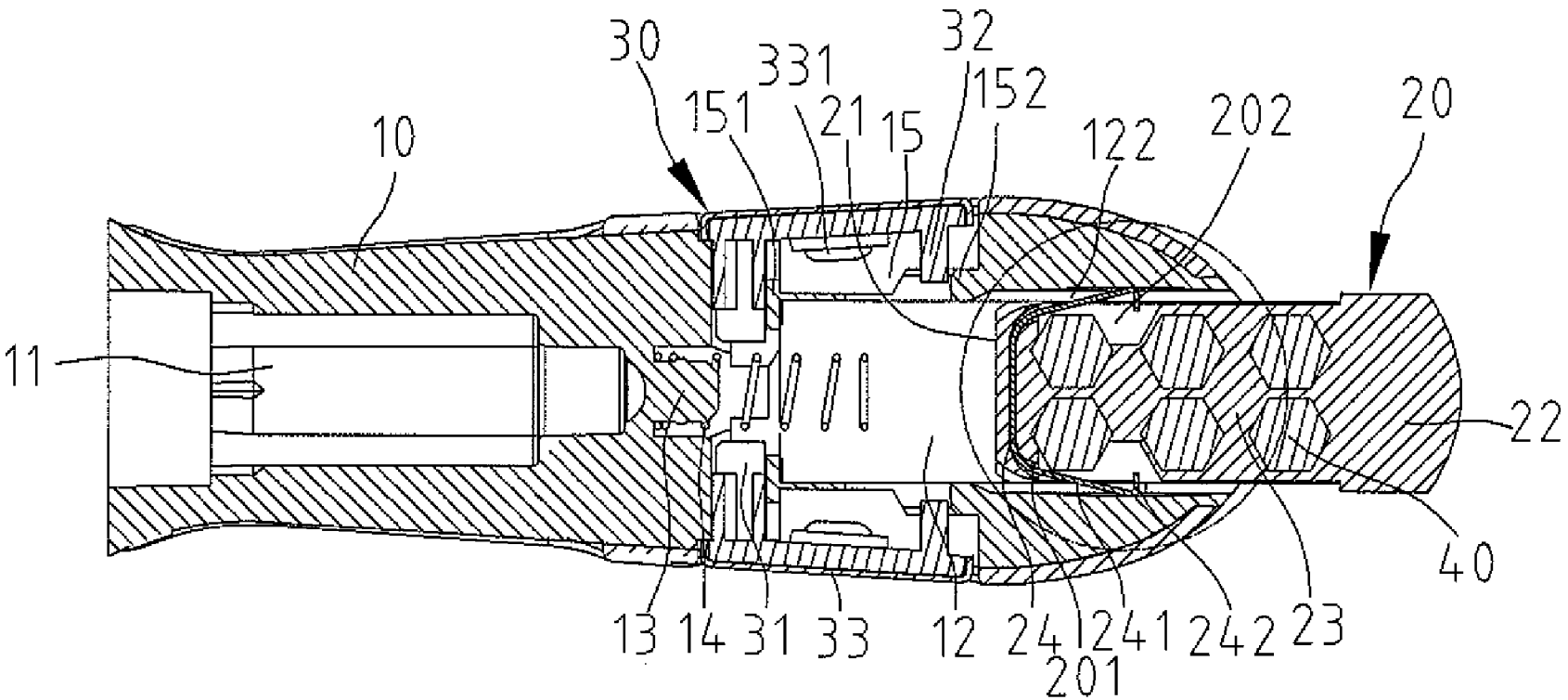
FIG. 11 is a sectional view similar to FIG. 9, wherein the bit carrier is in an ejected position.
Figure 12:
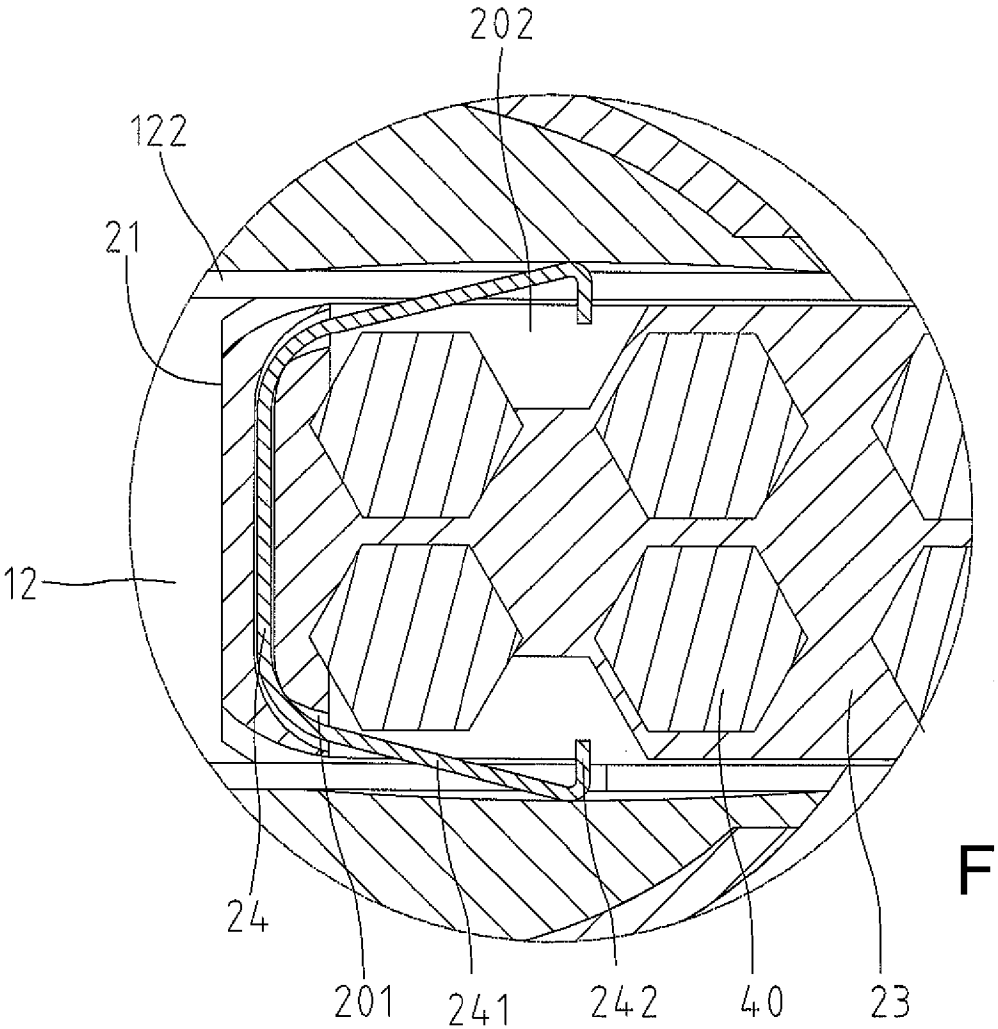
FIG. 12 is an enlarged view of a circled portion in FIG. 11.
Figure 13:
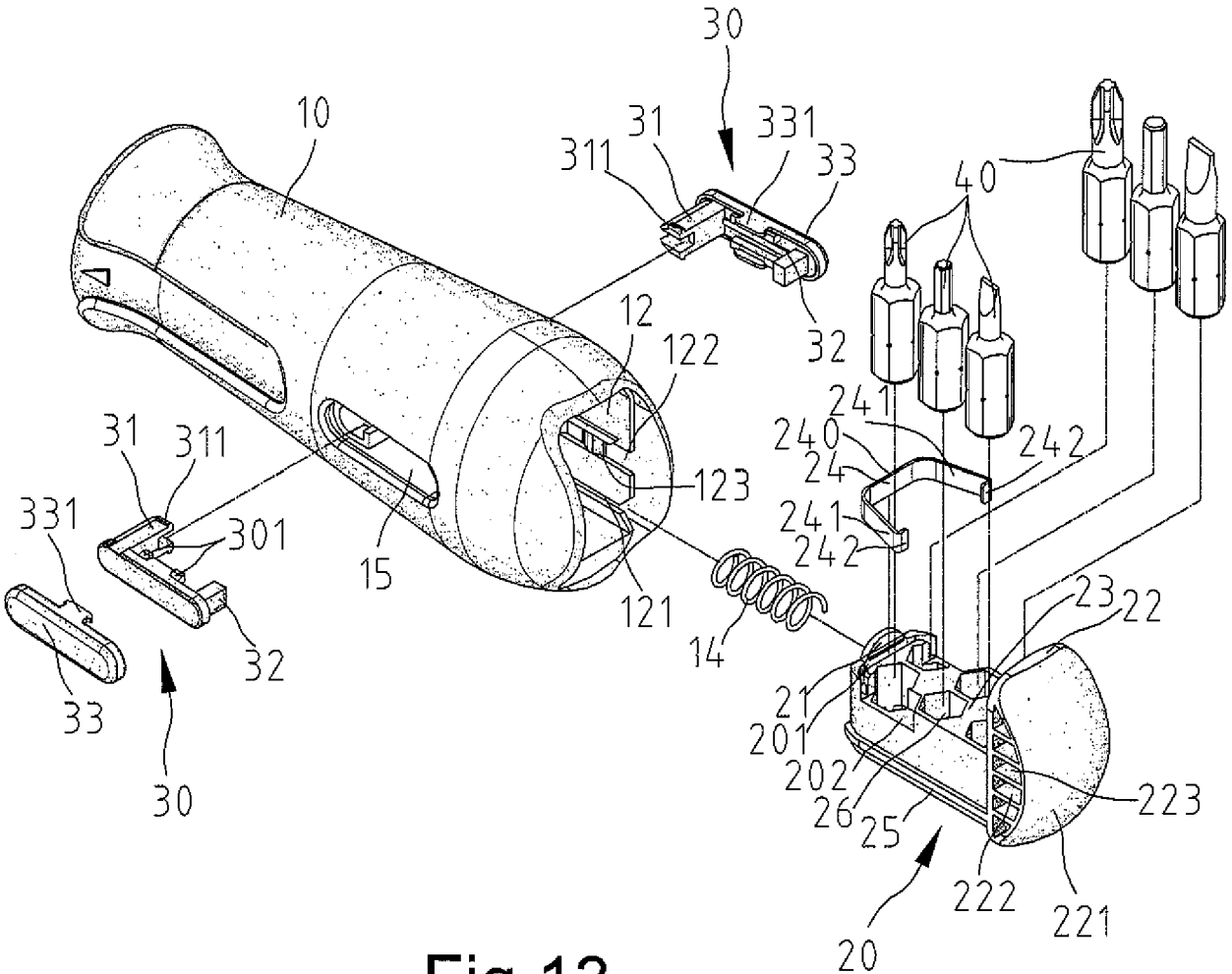
FIG. 13 is an exploded perspective view illustrating a third embodiment of the tool handle in accordance with the present invention.
Figure 14:
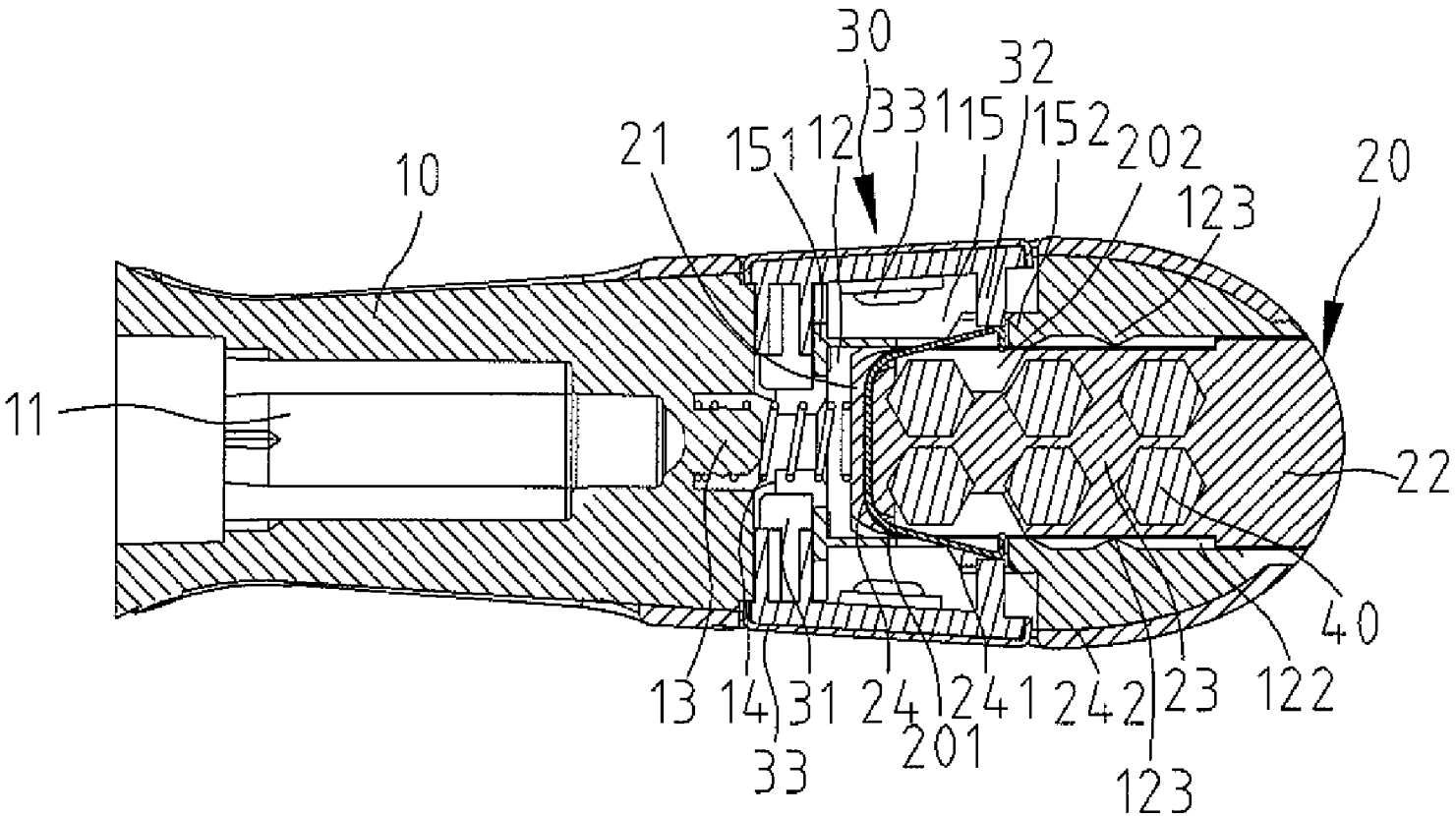
FIG. 14 is a sectional view of the tool handle in FIG. 13.
Figure 15:
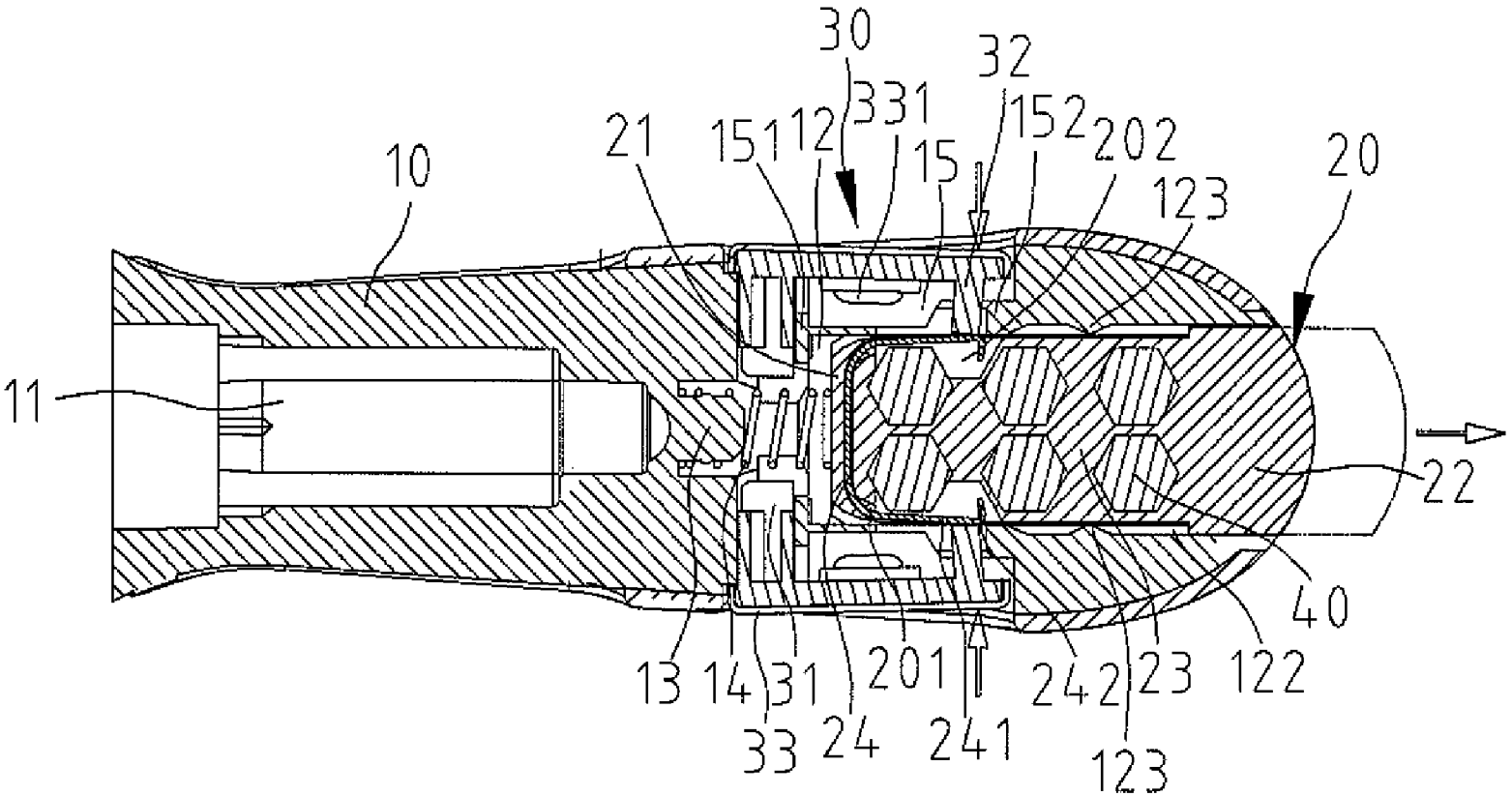
FIG. 15 is a sectional view similar to FIG. 14, illustrating ejection of a bit carrier of the tool handle.
Figure 16:
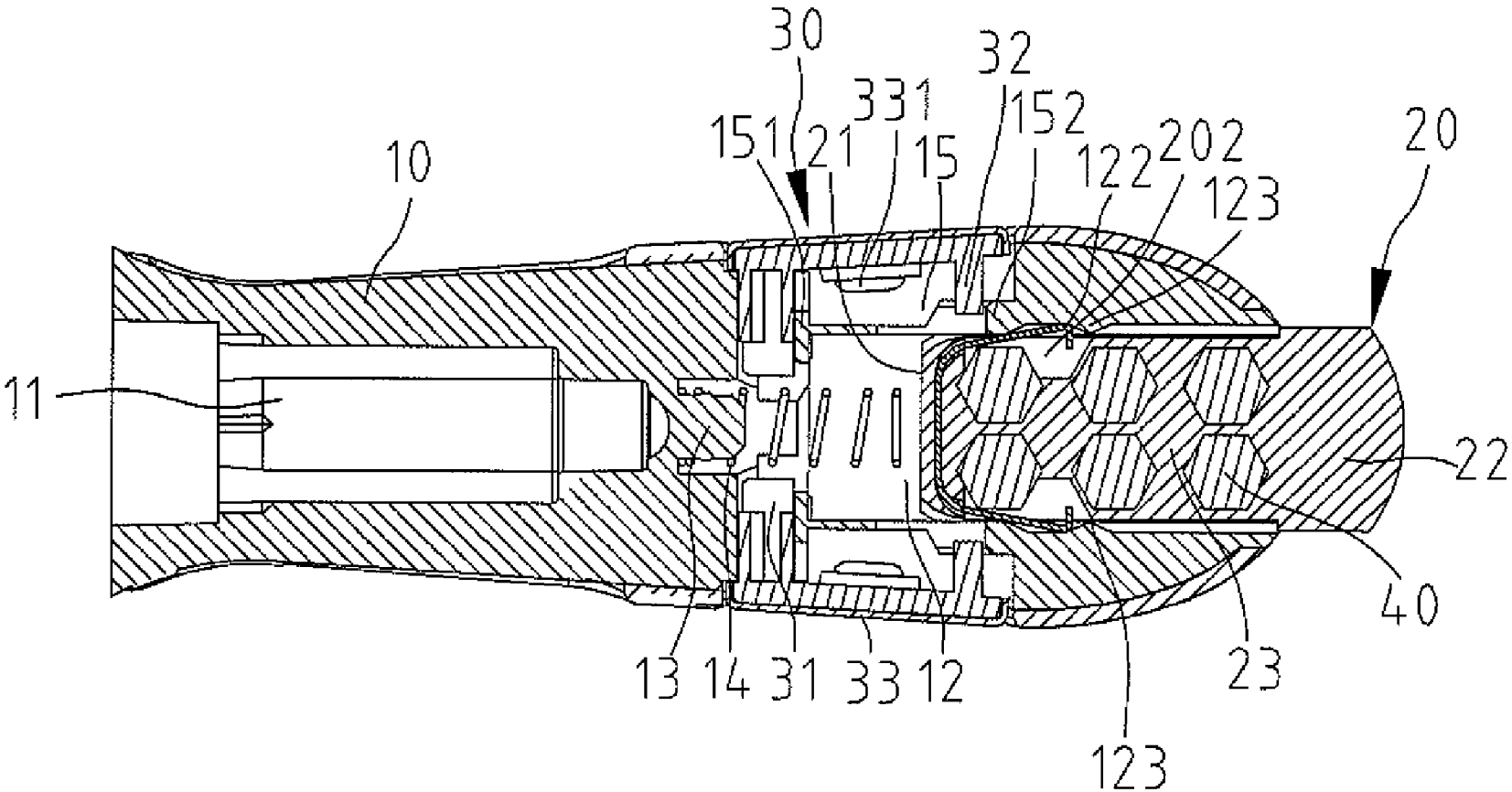
FIG. 16 is a sectional view similar to FIG. 14, wherein the bit carrier is in an ejected position.
Figure 17:
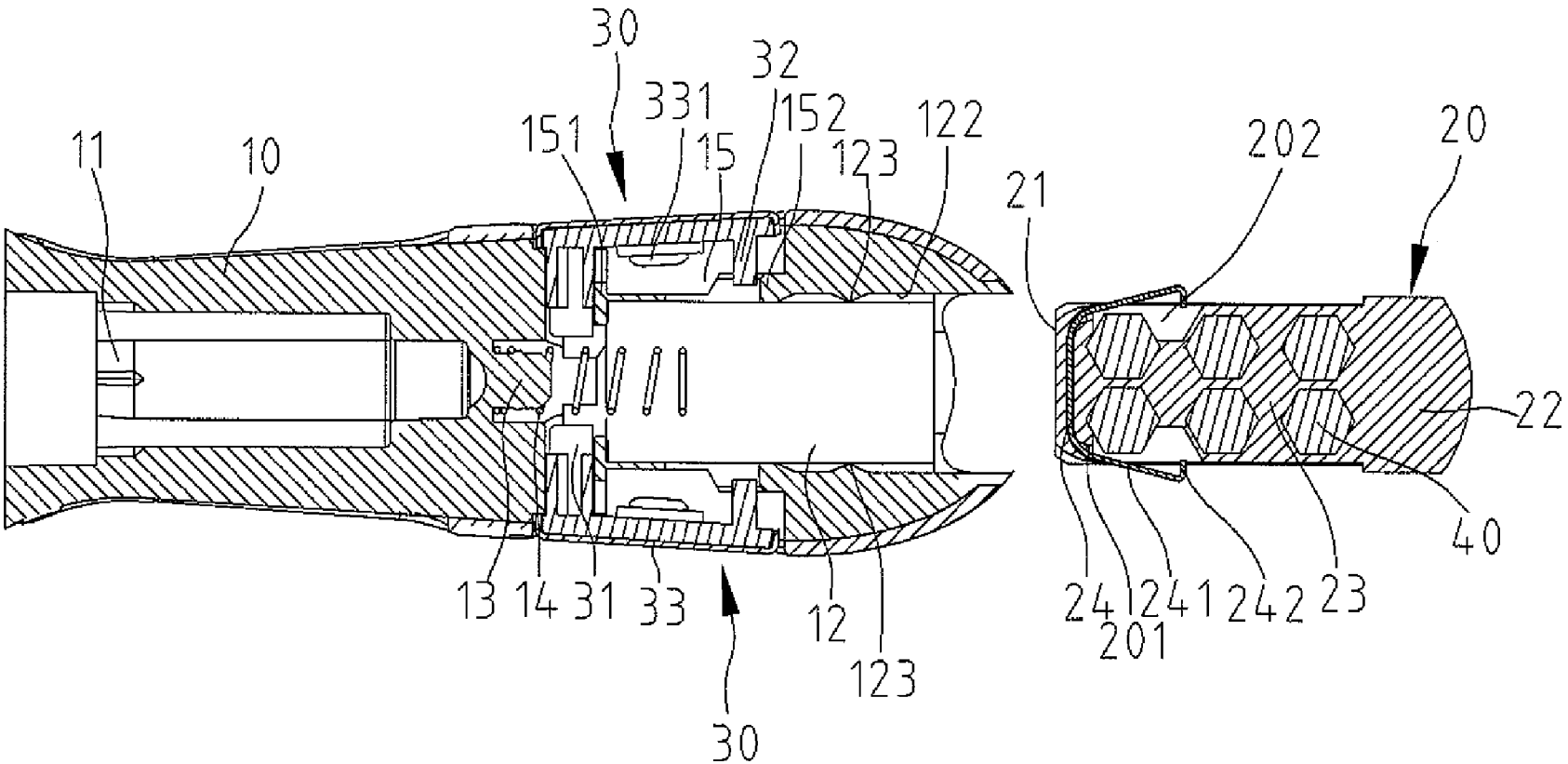
FIG. 17 is an exploded sectional view illustrating complete removal of the bit carrier from the tool handle in FIG. 16.

Referring to FIGS. 11 and 12, as mentioned above, since an outwardly extending force is imparted to each resilient arm 241 of the retaining member 24 during the sliding movement of the bit carrier 20, this outwardly extending force imparts a force to a bottom wall delimiting the associated arcuate guiding groove 122. Namely, a frictional force exists between each resilient arm 241 of the retaining member 24 and the bottom wall delimiting the associated arcuate guiding groove 122 of the body 10, preventing the bit carrier 20 from undesirably falling out of the body 10. The arcuate guiding grooves 122 of the body 10 provide a longer, non-rectilinear travel for the bit carrier 2O to enhance the fall-preventing effect for the bit carrier FIG. 13 is an exploded perspective view illustrating a third embodiment of the tool handle in accordance with the present invention. FIG. 14 is a sectional view of the tool handle in FIG. 13. FIG. 15 is a sectional view similar to FIG. 14, illustrating ejection of a bit carrier of the tool handle. FIG. 16 is a sectional view similar to FIG. 14, wherein the bit carrier is in an ejected position. FIG. 17 is an exploded sectional view illustrating complete removal of the bit carrier from the tool handle in FIG. 16.

In this embodiment, the bottom wall delimiting each guiding groove 122 of the body 10 includes a protrusion 123 for stopping the retaining section 242 of the associated resilient arm 241, thereby enhancing the fall-preventing effect for the bit carrier 20.

Figure 18:
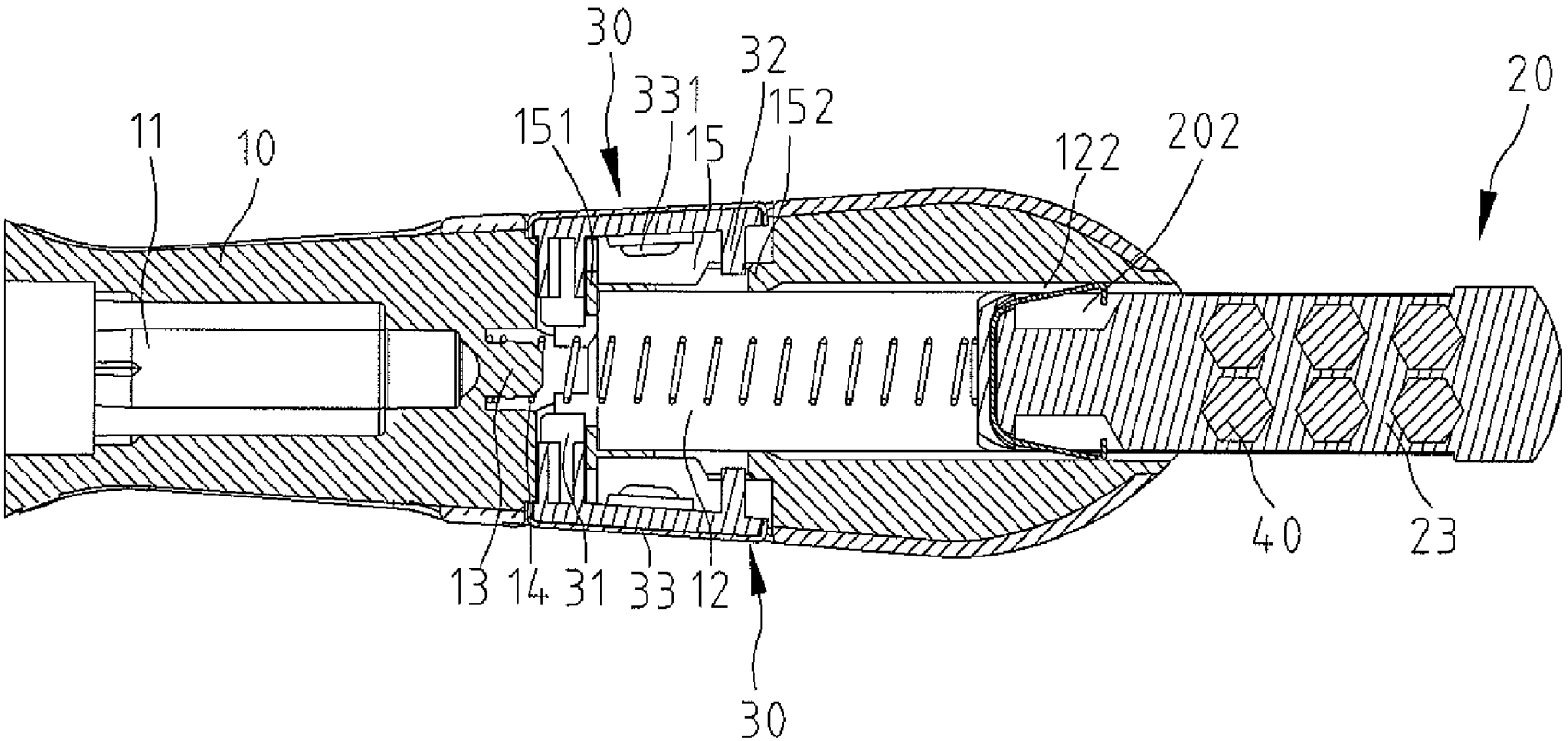
FIG. 18 is a sectional view illustrating a fourth embodiment of the tool handle in accordance with the present invention.

FIG. 18 illustrates a third embodiment of the tool handle in accordance with the present invention. In this embodiment, the bit-holding section 23 of the bit carrier 20 are exposed when the bit carrier 20 is in its ejected position, allowing easy retrieval or placement of bits 40 without the need of removal of the bit carrier 20 from the body 10. The length and elasticity of the elastic element 14 can be selected according to product needs.

Although specific embodiments have been illustrated and described, numerous modifications and variations are still possible without departing from the essence of the invention. The scope of the invention is limited by the accompanying claims.

What is claimed is:

1. A tool handle comprising:

a body including a first end and a second end, the first end of the body being adapted for coupling with a bit-coupling member, the second end of the body including a compartment, the body further including two lateral sides, one of the lateral sides having an opening in communication with the compartment;

a bit carrier mounted in the compartment of the body and movable relative to the body in a longitudinal direction, the bit carrier including a bit-holding section for holding at least one bit, a retaining member being mounted to the bit carrier for retaining the bit carrier to the body, with the retaining member including a main section and a resilient arm extending outward and rearward from an end of the main section; and an actuating member mounted in the opening of the body, the actuating member being operable to move the bit carrier from a storage position to an ejected position not falling out of the body and to impart a frictional force between the retaining member and the body to prevent the bit carrier from falling out of the body, with the actuating member including a pressing section abutting against the resilient arm of the retaining member.

2. The tool handle as claimed in claim 1, with the body including a stop formed in the opening, with the resilient arm of the retaining member abutting against the stop of the body when the bit carrier is in the storage position, thereby retaining the bit carrier in the compartment of the body.

3. The tool handle as claimed in claim 1, with the bit carrier including a recessed portion for receiving the resilient arm of the retaining member.

4. The tool handle as claimed in claim 1, with the bit carrier including an engaging groove for receiving the main section of the retaining member.

5. The tool handle as claimed in claim 1, with a lateral wall delimiting the compartment of the body including a guiding groove along which the resilient arm of the retaining member slides, and with the resilient arm including a retaining section in frictional contact with a wall delimiting the guiding groove.

6. The tool handle as claimed in claim 5, with the guiding groove being arcuate.

7. The tool handle as claimed in claim 5, with a bottom wall delimiting the guiding groove including a protrusion for stopping the retaining section of the resilient arm.

8. A tool handle comprising:

a body including a first end and a second end, the first end of the body being adapted for coupling with a bit-coupling member, the second end of the body including a compartment, the body further including two lateral sides, one of the lateral sides having an opening in communication with the compartment;

a bit carrier mounted in the compartment of the body and movable relative to the body in a longitudinal direction, the bit carrier including a bit-holding section for holding at least one bit, a retaining member being mounted to the bit carrier for retaining the bit carrier to the body, with the retaining member being a resilient metal plate; and an actuating member mounted in the opening of the body, the actuating member being operable to move the bit carrier from a storage position to an ejected position not falling out of the body and to impart a frictional force between the retaining member and the body to prevent the bit carrier from falling out of the body.

9. The tool handle as claimed in claim 8, with the body further including another opening in the other lateral side thereof, and with the tool handle further including another actuating member mounted in said another opening, said another actuating member and said actuating member being operable to together move the bit carrier from the storage position to the ejected position and to impart the frictional force between the retaining member and the body to prevent the bit carrier from falling out of the body.

10. The tool handle as claimed in claim 8, with the opening of the body including an engaging portion, with the actuating member including a coupling section coupled with the engaging portion.

11. The tool handle as claimed in claim 8, with the tool handle further comprising a metal plate mounted to an outer side of the actuating member.

12. The tool handle as claimed in claim 8, with the bit carrier being forcibly removable from the compartment of the body.

13. The tool handle as claimed in claim 8, with the compartment of the body being delimited by two lateral walls each having a longitudinally extending groove, with the bit carrier including two longitudinal ribs slidingly received in the grooves of the body.

14. The tool handle as claimed in claim 8, with the tool handle further including an elastic element mounted in the compartment for biasing the bit carrier outward.

15. The tool handle as claimed in claim 14, with the compartment of the body being delimited by an end wall, the end wall including a fixing block to which an end of the elastic element is mounted.

16. The tool handle as claimed in claim 15, with the end wall including a recess in which the fixing block is formed.

17. The tool handle as claimed in claim 8, with at least a portion of the bit-holding section is exposed when the bit carrier is in the ejected position.

18. The tool handle as claimed in claim 8, with the bit-holding section being completely exposed when the bit carrier is in the ejected position.

19. The tool handle as claimed in claim 8, with the retaining member including a main section and a resilient arm extending outward and rearward from an end of the main section, and with the actuating member including a pressing section abutting against the resilient arm of the retaining member.

20. A tool handle comprising:

a body including a first end and a second end, the first end of the body being adapted for coupling with a bit-coupling member, the second end of the body including a compartment, the body further including two lateral sides, each of the lateral sides having an opening in communication with the compartment;

a bit carrier mounted in the compartment of the body and movable relative to the body in a longitudinal direction, the bit carrier including a bit-holding section for holding at least one bit, a retaining member being mounted to the bit carrier for retaining the bit carrier in the compartment of the body, with the retaining member being substantially U-shaped and including a main section and two resilient arms extending outward and rearward from two ends of the intermediate section; and two actuating members respectively mounted in the openings of the body, with each said actuating member including a pressing section abutting against an associated one of the resilient arms of the retaining member, said actuating members being operable to move the bit carrier from a storage position to an ejected position not falling out of the body and to impart a frictional force between the retaining member and the body to prevent the bit carrier from falling out of the body.

21. The tool handle as claimed in claim 20, with the body including two stops respectively formed in the openings, with each said resilient arm of the retaining member abutting against an associated one of the stops of the body when the bit carrier is in the storage position, thereby retaining the bit carrier in the compartment of the body.

22. The tool handle as claimed in claim 20, with the bit carrier including two recessed portions for receiving the resilient arms of the retaining member.

23. The tool handle as claimed in claim 20, with the bit carrier including an engaging groove for receiving the main section of the retaining member.

24. The tool handle as claimed in claim 20, with each of two lateral wall delimiting the compartment of the body including a guiding groove along which an associated one of the resilient arms of the retaining member slides, and with each said resilient arm including a retaining section in frictional contact with a wall delimiting an associated one of the guiding grooves.

25. The tool handle as claimed in claim 24, with each said guiding groove being arcuate.

26. The tool handle as claimed in claim 24, with a bottom wall delimiting each said guiding groove including a protrusion for stopping the retaining section of an associated one of the resilient arms.

27. A tool handle comprising:

a body including a first end and a second end, the first end of the body being adapted for coupling with a bit-coupling member, the second end of the body including a compartment, the body further including two lateral sides, each of the lateral sides having an opening in communication with the compartment;

a bit carrier mounted in the compartment of the body and movable relative to the body in a longitudinal direction, the bit carrier including a bit-holding section for holding at least one bit, a retaining member being mounted to the bit carrier for retaining the bit carrier in the compartment of the body, with the retaining member being a resilient metal plate; and two actuating members respectively mounted in the openings of the body, said actuating members being operable to move the bit carrier from a storage position to an ejected position not falling out of the body and to impart a frictional force between the retaining member and the body to prevent the bit carrier from falling out of the body.

28. The tool handle as claimed in claim 27, with each said opening of the body including an engaging portion, with each said actuating member including a coupling section coupled with the engaging portion of an associated one of the openings.

29. The tool handle as claimed in claim 27, with the tool handle further comprising a metal plate mounted to an outer side of each said actuating member.

30. The tool handle as claimed in claim 27, with the bit carrier being forcibly removable from the compartment of the body.

31. The tool handle as claimed in claim 30, with the bit carrier including an anti-sliding portion on each of two sides thereof, allowing the bit carrier to be grasped by a user for forcibly removing the bit carrier out of the compartment of the body.

32. The tool handle as claimed in claim 31, with at least one of said anti-sliding portions including at least one groove for reducing a weight of the bit carrier.

33. The tool handle as claimed in claim 27, with the compartment of the body being delimited by two lateral walls each having a longitudinally extending groove, with the bit carrier including two longitudinal ribs slidingly received in the grooves of the body.

34. The tool handle as claimed in claim 27, with the tool handle further including an elastic element mounted in the compartment for biasing the bit carrier outward.

35. The tool handle as claimed in claim 27, with the compartment of the body being delimited by an end wall, the end wall including a fixing block to which an end of the elastic element is mounted.

36. The tool handle as claimed in claim 35, with the end wall including a recess in which the fixing block is formed.

37. The tool handle as claimed in claim 27, with at least a portion of the bit-holding section is exposed when the bit carrier is in the ejected position.

38. The tool handle as claimed in claim 27, with the bit-holding section being completely exposed when the bit carrier is in the ejected position.

* * * * *